US006682363B1

(12) United States Patent
Chang

(10) Patent No.: US 6,682,363 B1
(45) Date of Patent: Jan. 27, 2004

(54) INSULATION PIERCING CONNECTOR

(75) Inventor: Yung Tung Chang, Taipei (TW)

(73) Assignee: Hsu & Overmatt Co., Ltd., Taipei (TW)

( * ) Notice: Subject to any disclaimer, the term of this patent is extended or adjusted under 35 U.S.C. 154(b) by 0 days.

(21) Appl. No.: 10/370,474

(22) Filed: Feb. 24, 2003

(51) Int. Cl.[7] ..... H01R 11/20
(52) U.S. Cl. ..... 439/409; 439/418; 439/76.1
(58) Field of Search ..... 439/409, 418, 439/76.1, 404, 676

(56) References Cited

U.S. PATENT DOCUMENTS 5,762,518 A * 6/1998 Tanigawa et al. ..... 439/409
5,947,761 A * 9/1999 Pepe ..... 439/409
6,116,943 A * 9/2000 Ferrill et al. ..... 439/418

* cited by examiner

*Primary Examiner*—Tho D. Ta
(74) *Attorney, Agent, or Firm*—Rosenberg, Klein & Lee

(57) ABSTRACT

An electric connector includes a socket having a connecting bite at the bottom, and a plurality of gutters at the front communicating with a rabbet which has a plurality of conductors. The front of each conductor electrically connects to a metal pin and the rear of each conductor electrically connects to a board. The board has a plurality of assembling holes for receiving a plurality of golden pins. The socket and board are installed on a base.

7 Claims, 4 Drawing Sheets

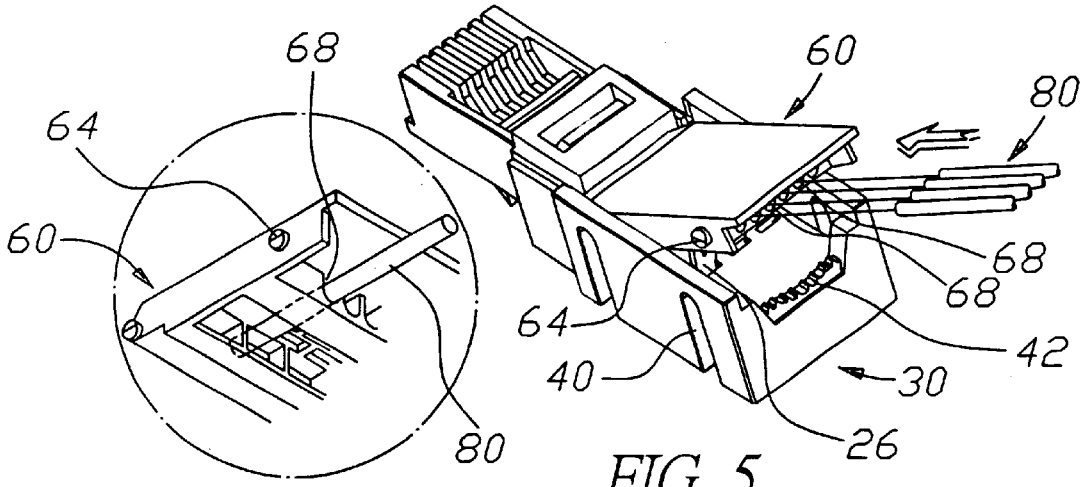
FIG. 6
FIG. 5
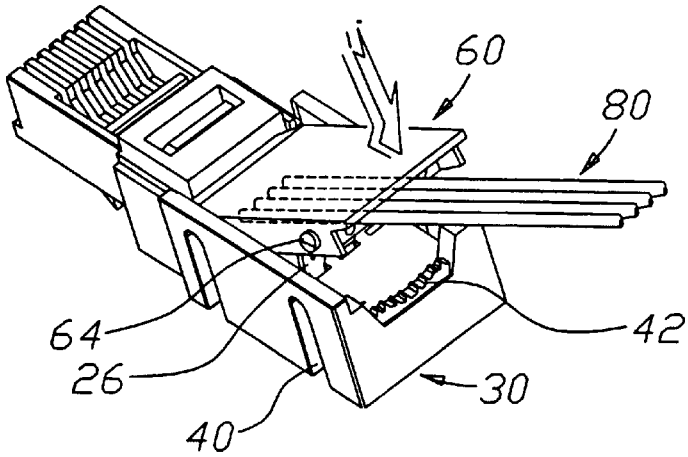
FIG. 7
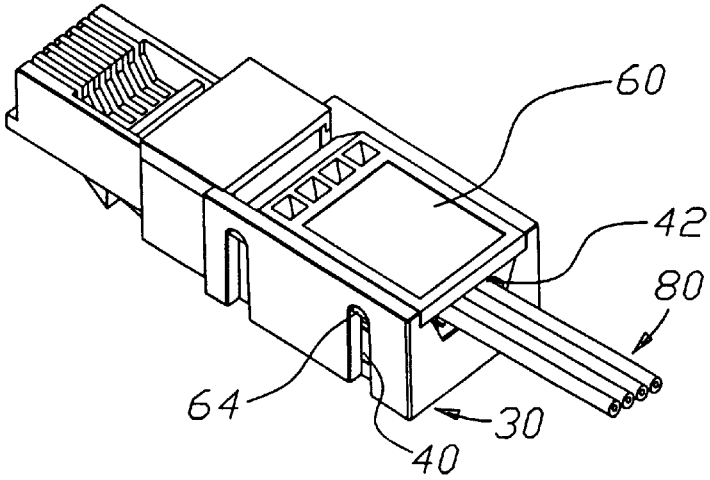
FIG. 8

INSULATION PIERCING CONNECTOR

BACKGROUND OF THE INVENTION

1. Field of the Invention

The present invention relates to an electric connector, more particularity, to an electric connector having a structure for connecting the conductors without the use of hand tools.

2. Description of the Prior Art

There are many wired telecommunication and network apparatuses installed in homes or offices. Any of the transmission apparatuses needs the wire installed for transferring the data or electric signals, and two conductors need a connector to be coupled together. There are many kinds of connectors used in accordance with the number of conductors such as telecommunication devices have four to six electric junctions and network devices need six to eight electric junctions.

Before a conductor is coupled to the connector, the insulation must be peeled-off from the conductor by a hand tool. Therefore, the conductors of the wires can connect to the connector by using a hand tool. The disadvantages include an increase in the assembly cost by the use of a hand tool.

SUMMARY OF THE INVENTION

It is an object of the present invention is to provide an electric connector having a structure that does not require a hand tool for assembling a conductor to the connector.

It is another object of the present invention is to provide an electric connector which uses a plurality of holes for ordering the conductors inserted therein, so that it is convenient to assemble.

An electric connector of the present invention comprises a socket having a connecting bite at the bottom, and a plurality of gutters at the front communicating with a rabbet that passes a plurality of conductors therethrough. The front of each conductor electrically connects to a metal pin and the rear of the conductor electrically connects to a board. The board has a plurality of assembling holes for placing a plurality of golden pins therein. Further more, the socket and board install on a base.

The base has a basement which includes two walls at opposite sides of the basement, each wall having a pivotal hole at a front side and a fastening hole at each rear side. The base further includes a cap for fastening the board, which has a plurality of positioning holes disposed in correspondence to the assembling holes for positioning golden pins of the board, and a sheet that includes a pivotal column and a fastening column on each side thereof and disposed in respective correspondence to the positioning hole and fastening hole on each side of the base for pivoting the sheet on the base. There are a plurality of holes of the sheet for the convenience of assembling conductors into the connector.

BRIEF DESCRIPTION OF THE DRAWINGS

The above and further objects, features and advantages of the invention will become clear from the following more detailed description when read with reference to the accompanying drawings in which:

FIG. 5 is a schematic view showing installation of the conductors on in the connector of the present invention;

FIG. 6 is a partial enlarged view showing installation of the conductors on in the connector of the present invention;

FIG. 7 is a schematic view showing insertion of the conductors into the connector of the present invention; and FIG. 8 is a schematic view showing complete operation of connector of the present invention.

DETAILED DESCRIPTION OF THE PREFERRED EMBODIMENTS

Figure 1:
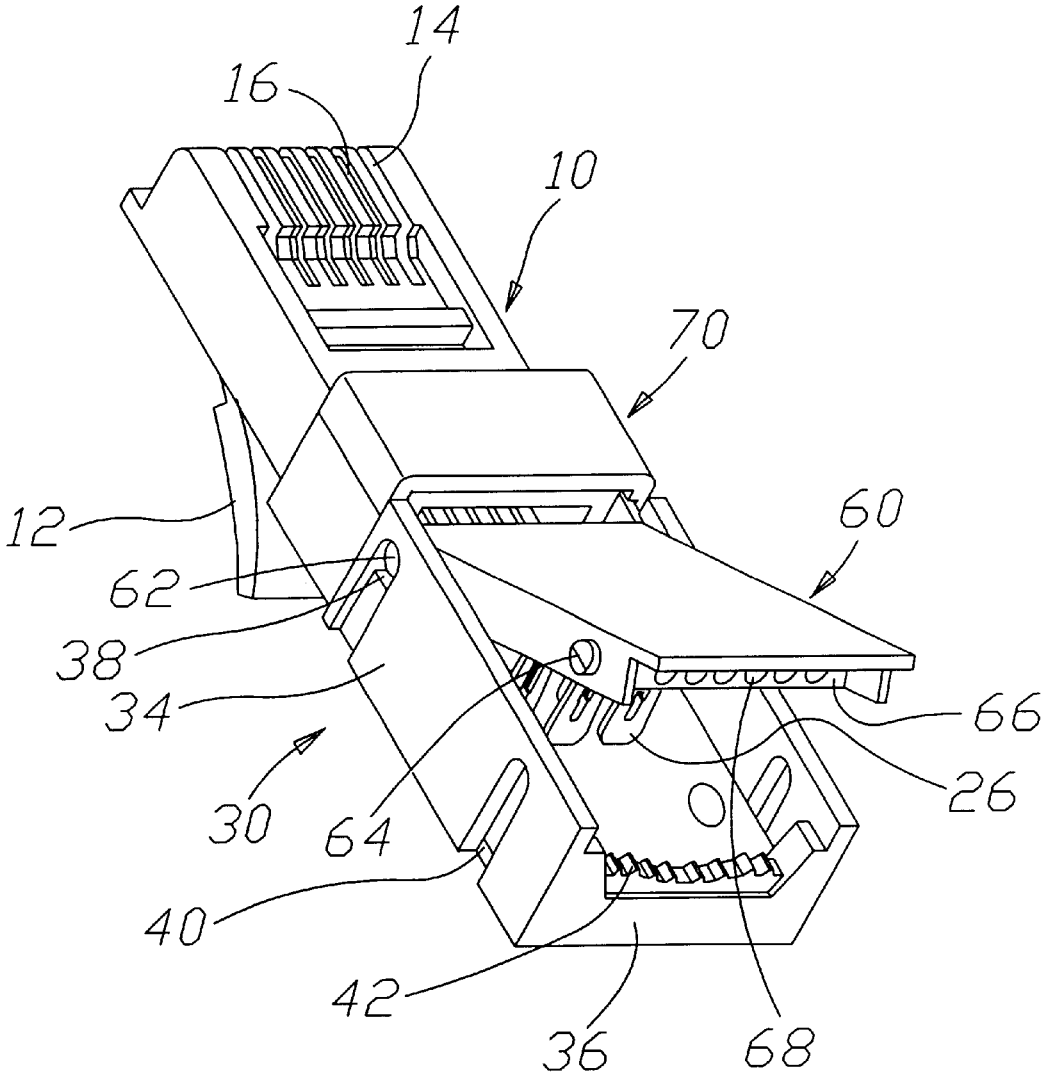
FIG. 1 is a perspective view of the present invention.
Figure 2:
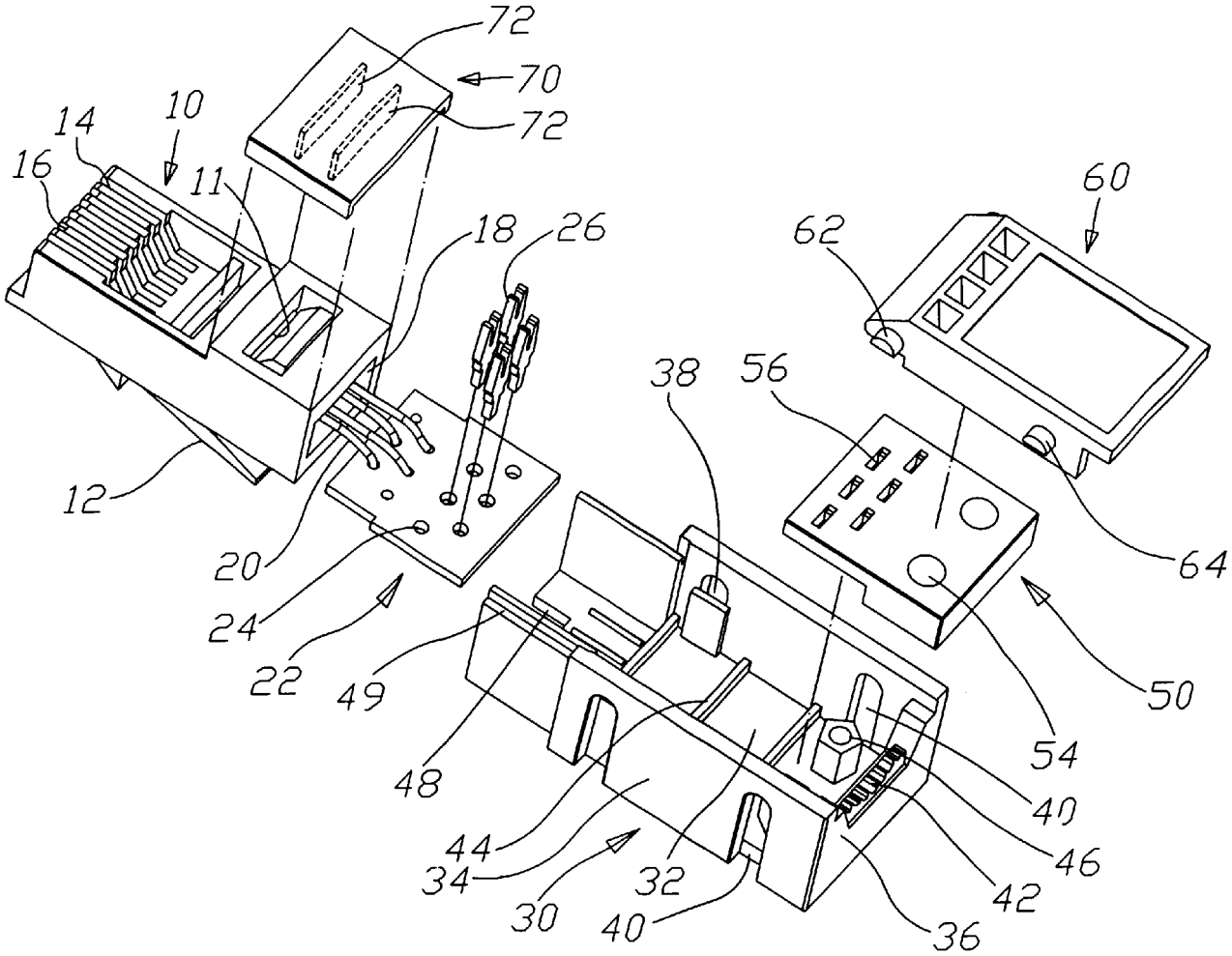
FIG. 2 is an perspective exploded view of the present invention.
Figure 3:
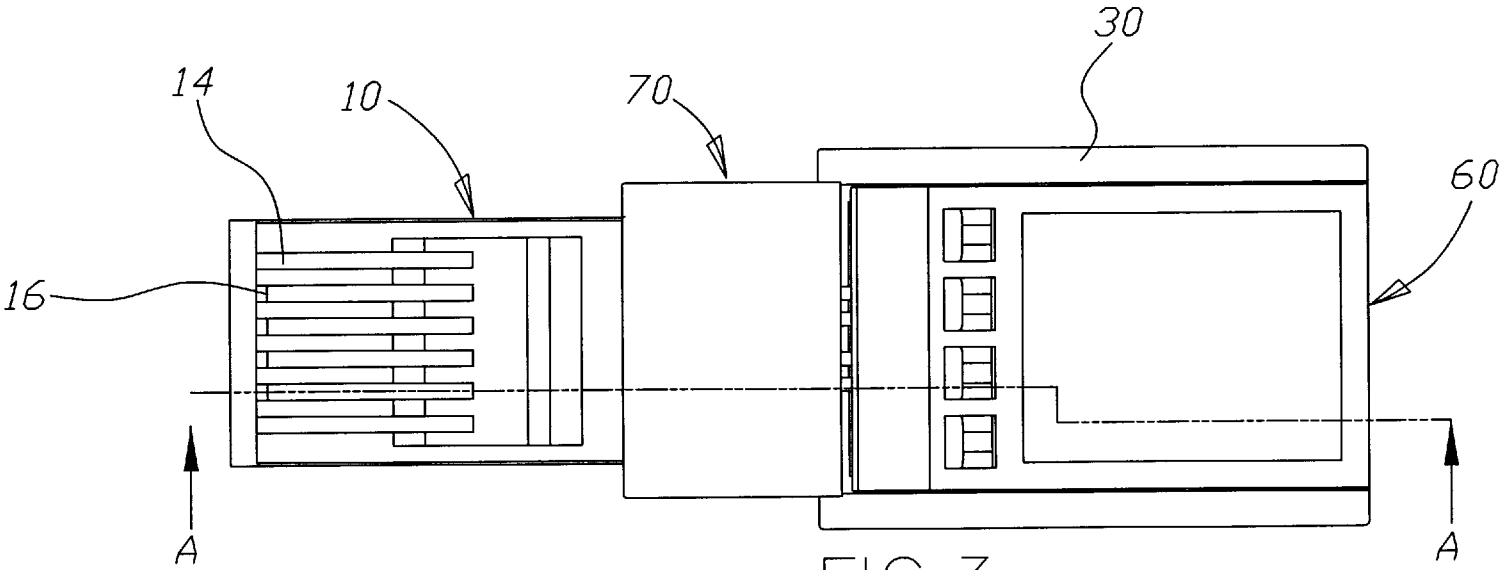
FIG. 3 is a top view of the present invention.
Figure 4:
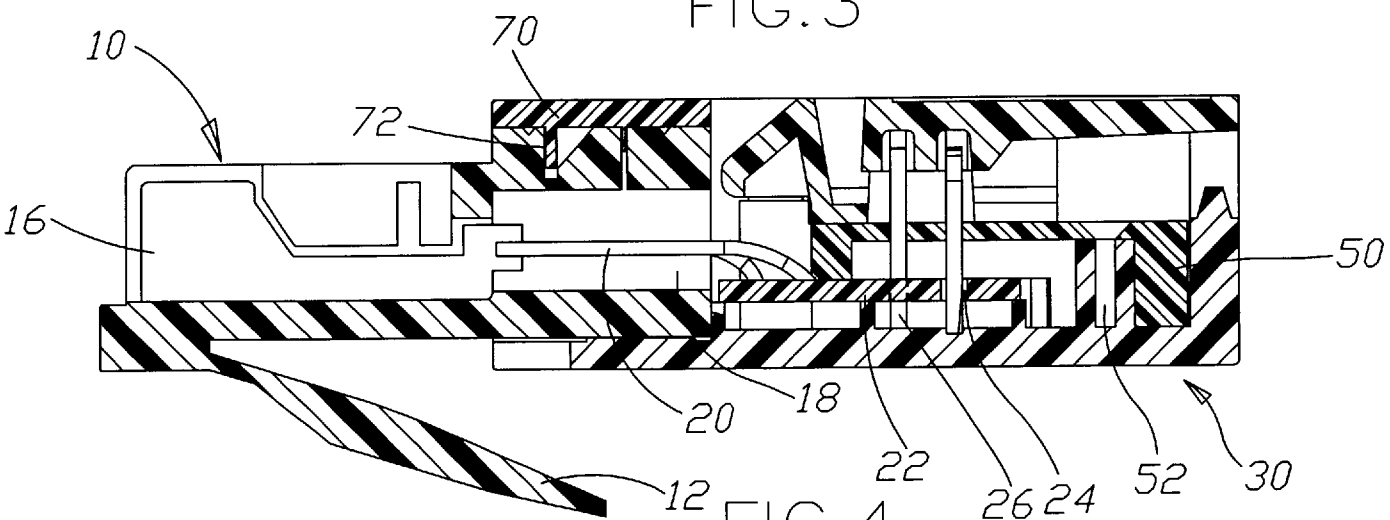
FIG. 4 is a cross-sectional view of the present invention taken along the section line A—A of FIG. 3.

Refer to FIGS. 1, 2, 3, and 4, the electric connector of the present invention comprises a socket 10 having a connecting hole 11 at the rear top portion of socket 10 and a connecting bite 12 at bottom of socket 10. And, the socket 10 comprises a plurality of gutters at the front end of socket 10, which gutters that receive a metal pin 16 therein, wherein the amount of metal pins can be set to 4, 6 or 8 metal pins, according to the connecting apparatus. The bottom of socket 10 communicates with the gutters by a rabbet having a plurality of conductors 20 passing therethrough, wherein the two ends of the conductors 20 electrically couple to the metal pin 16 and a board 22, respectively. The board 22 includes a plurality of assembling holes 24 for assembling a plurality of golden pins 26 to thereby be respectively electrically coupled to the plurality of conductors 20, each golden pin 26 having a forked shape. The number of golden pins can be 2, 4, 6, or 8 pins, according to the application. Referring to FIG. 2, the number of metal pins 16 is 6 pins and the number of golden pins 26 is 4 pins, forming a 6P/4C type.

The socket 10 and board 22 are installed on a base 30. The base 30 includes a basement 32 which has two walls 34 on opposing sides thereof and rear wall 36 wherein the front of each wall 34 has a pivotal hole 38 and the rear of each wall 34 has a fastening hole 40. The basement 32 includes a plurality of ribs 44 for supporting the socket 10 and board 22. The rear of basement 32 has at least one screw column 46, and the front of basement 32 has a placing gutter 48 disposed in correspondence to the connecting bite 12 of socket 10 for receiving the connecting bite 12. And, the front of base 30 places a chute 49 on opposing sides thereof.

A cap 50 is coupled to the base 30 by a screw 52 connecting the screw column 46 of base 30 for fastening the board 22. The cap 50 comprises a plurality of positioning holes 56 disposed in correspondence to the assembling holes 24 of board 22 for positioning the golden pins 26. Further, a sheet (stuffer cap) 60 pivotally connects to the base 30. The sheet 60 has a pivotal column 62 formed on opposing sides thereof and in respective correspondence with the pivotal holes 38 of base 30. The rear of sheet 60 has a fastening column 64 formed on opposing sides thereof for respective fastening to the fastening holes 40. The sheet 60 includes a connecting opening 66 having a plurality of holes 68 for ordering the conductors. Further, the top of socket 10 includes a cap 70 which connects the rabbet 18 of socket 10 by an assembly 72 of cap 70.

Referring to FIGS. 5, 6, 7, and 8, when the plurality of conductors 80 are orderly inserted into the holes 68, the fastening column 64 couples to the fastening holes 40 by pressing the sheet 60 down. The insulation of the conductors 80 is peeled by the golden pins 26, and the golden pins 26 make electrical contact with the conductors 80.

The electric connector of the present invention discloses using the conductors 80 orderly inserted into the holes 68 and then pressing the sheet 60, thereby solving the conventional assembly problems where a conductor is connected to the connector using a tool. The metal pins 16 of present invention can number 4, 6 and 8 correspond to the golden pins 26 that can number 2, 4, 6, and 8, according to the connecting apparatus. Additionally, for use in wire for telecommunications, the pins 16 can number 4 or 2 and correspond to the golden pins 26 that can number 4 or 2.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An electric connector for a plurality of wires, comprising:

a socket having a plurality of gutters, a plurality of metal pins respectively received in the plurality of gutters, and a connecting bite at a bottom of the socket, the socket having a rabbet which communicates with the gutters;

a board having a plurality of conductors coupled thereto and a plurality of assembling holes, wherein the conductors extend through the rabbet and are respectively electrically coupled to the plurality of metal pins;

a plurality of golden pins respectively mounted in the plurality of assembling holes of the board and respectively electrically coupled to the plurality of conductors, each of the plurality of golden pins having a contour for piercing insulation of a respective one of the plurality of wires and making electrical contact with of a conductor of the wire;

a base for receiving the socket and board having a basement formed between a pair of side walls, each of the side walls having a pivotal hole adjacent an upper front portion of the wall and a fastening hole adjacent an upper rear portion of the wall;

a first cap mounted on the base and having a plurality of positioning holes disposed in respective correspondence with the plurality of assembling holes for positioning the plurality of golden pins; and a stuffer cap having a pivotal column respectively formed on opposing front side portions thereof and pivotally engaged with a corresponding pivotal hole of the base, a fastening column formed on opposing rear side portions thereof for respective engagement with a corresponding fastening hole of the base, and a plurality of holes formed in an inner surface of the stuffer cap for respectively receiving the plurality of wires therein.

2. The electric connector of claim 1, wherein each of the golden pins is formed with a forked shape.

3. The electric connector of claim 1, wherein the base has a plurality of ribs formed therein for supporting the socket and board.

4. The electric connector of claim 1, wherein the socket has a connecting bite formed thereon disposed in correspondence to a placing gutter formed in the base.

5. The electric connector of claim 1, wherein a second cap overlays a rear top portion of socket.

6. The electric connector of claim 5, wherein the second cap has at least one assembly formed thereon for coupling with the rabbet of the socket.

7. The electric connector of claim 5, wherein the second cap is coupled to an upper front portion of the side walls of the base.

* * * * *